US008157006B2

(12) United States Patent
Koleilat et al.

(10) Patent No.: US 8,157,006 B2
(45) Date of Patent: Apr. 17, 2012

(54) TELESCOPIC FRACTURING ISOLATION SLEEVE

(75) Inventors: Bashir Koleilat, Houston, TX (US); Sean Gresham, Houston, TX (US); David Cain, New Braunfels, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 355 days.

(21) Appl. No.: 12/396,597

(22) Filed: Mar. 3, 2009

(65) Prior Publication Data

US 2010/0051261 A1 Mar. 4, 2010

Related U.S. Application Data

(60) Provisional application No. 61/033,329, filed on Mar. 3, 2008.

(51) Int. Cl.
*E21B 28/00* (2006.01)
*E21B 19/00* (2006.01)

(52) U.S. Cl. ..... 166/177.5; 166/89.3; 166/86.2; 166/75.14

(58) Field of Classification Search ..... 166/75.13, 166/75.14, 86.1, 86.2, 88.1, 90.1, 92.1, 109, 166/177.5, 194, 242, 380, 381, 382; 277/332, 277/338, 530; 285/32, 300, 302, 314
See application file for complete search history.

(56) References Cited

U.S. PATENT DOCUMENTS

| | | | | |
|---|---|---|---|---|
| 4,697,829 | A * | 10/1987 | Pond | 285/18 |
| 5,785,121 | A | 7/1998 | Dallas | |
| 6,220,363 | B1 | 4/2001 | Dallas | |
| 6,447,021 | B1 * | 9/2002 | Haynes | 285/302 |
| 6,516,861 | B2 | 2/2003 | Allen | |
| 7,308,934 | B2 * | 12/2007 | Swagerty et al. | 166/177.5 |
| 7,743,824 | B2 * | 6/2010 | Lam et al. | 166/177.5 |
| 7,806,175 | B2 * | 10/2010 | Hickie | 166/75.13 |
| 2003/0024709 | A1 * | 2/2003 | Cuppen | 166/382 |
| 2003/0205385 | A1 | 11/2003 | Duhn et al. | |
| 2003/0221838 | A1 | 12/2003 | Dallas | |
| 2008/0011469 | A1 | 1/2008 | Swagerty et al. | |

OTHER PUBLICATIONS

Third party drawing of assembly of isolation sleeve dated Aug. 6, 1987.
International Search Report for International Patent Application No. PCT/US2009/035815, European Patent Office, dated Feb. 1, 2010.
Written Opinion for International Patent Application No. PCT/US2009/035815, European Patent Office, dated Feb. 1, 2010.

* cited by examiner

*Primary Examiner* — Giovanna Wright
*Assistant Examiner* — Michael Wills, III
(74) *Attorney, Agent, or Firm* — Locke Lord LLP

(57) ABSTRACT

The disclosure provides a fracturing isolation sleeve for a wellhead assembly including a fracturing adapter and tubing head. In at least one embodiment, the sleeve can telescopic to different lengths to fit different assemblies without necessitating switching the sleeve or portions thereof. The sleeve can be coupled to the wellhead assembly by threaded and non-threaded connections. The sleeve upper portion can be threadably engaged with the wellhead assembly, and/or the sleeve lower portion can be threadably engaged with a packoff bushing rotationally coupled to the wellhead assembly through an anti-rotation mechanism. Further, the sleeve can include a retaining nut to be threadably engaged with the wellhead assembly without necessarily rotating the sleeve upper or lower portions. The sleeve can be also coupled with the wellhead assembly through a mandrel coupled to the sleeve having an actuating cam surface to actuate a lock ring with the wellhead assembly.

6 Claims, 11 Drawing Sheets

TELESCOPIC FRACTURING ISOLATION SLEEVE

CROSS REFERENCE TO RELATED APPLICATIONS

This application claims the benefit of U.S. Provisional Appl. No. 61/033,329, filed Mar. 3, 2008, and is incorporated herein by reference.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND

1. Field of the Invention The disclosure relates to pile oil field equipment, and particularly for oil field equipment designed to drilling and production of hydrocarbons from oil and gas wells.

2. Description of Related Art

It is a common practice when drilling and producing an oil or gas well to insert casing into the drilled hole and mount a wellhead assembly above ground to the casing. The wellhead assembly is a series of stacked devices, each having an internal bore aligned with the casing. For example, a casing head is mounted to the casing, followed by a tubing head with a packoff bushing disposed therein, followed by a blowout preventer and other devices. Production tubing is generally suspended from the wellhead assembly during normal operations to conduct production fluids, such as oil and natural gas and other fluids, to the surface and out of the well to production facilities for processing. As the well is drilled deeper, the well pressure is expected to increase. Consequently, the pressure rating of the wellhead stack needs to increase, as do the element sizes and lengths. Seals are used between the casing and tubing hangers and other wellhead devices along the surfaces to which they interact.

Some wells require additional steps to enhance production or "stimulate" the well through a technique known as "fracturing." The process of fracturing generally pumps high pressure fluids down the casing and into the production strata to expand the porosity and interstitial spaces of the strata and allow production fluids to flow more easily therethrough. However, the fracturing process can involve abrasive fluids that can harm seals and other portions of the devices in the wellhead assembly. The fracturing pressure can also exceed the production pressure ratings of the wellhead assembly. Thus, it is common to use a fracturing isolation sleeve that slides into the internal bore of the wellhead assembly. An isolation sleeve with seals on its outside diameter at least partially isolates the wellhead devices, such as a tubing head with its outlets and other ports, from high fracturing pressures and fluids. To facilitate the fracturing process, generally a fracturing adapter is added to the wellhead assembly stack of devices above the tubing head. The isolation sleeve can be slipped at least partially into the fracturing adapter, coupled to the fracturing adapter, and sealably engaged with one or more devices of the wellhead assembly. The fracturing fluid can flow through an internal bore of the isolation sleeve while the sleeve at least partially isolates and protects the internal bore of the wellhead assembly.

It has been quite common for years to use lock down pins extending through the wall of the wellhead assembly to support devices within the internal bore of the wellhead assembly, such as casing hangers, tubing hangers, and other internal devices which are commonly used in the oil field tooling. Known fracturing sleeves are usually held in place by a set of such lock down pins. Also, known isolation sleeves have an inner diameter that is equal to or greater than the casing or other tubular element that is in place during the fracturing process. That relative inner diameter allows equipment sized up to the full bore of the tubular element to pass through the isolation sleeve at various stages of the fracturing process.

Installing the isolation sleeve is generally in a downward direction by inserting the sleeve through one or more wellhead devices into the fracturing adapter and/or other devices of the wellhead assembly. However, removal in the reverse upward direction can be difficult. After a fracturing operation, the sleeve can become hard to remove manually due to the extreme pressures and can cause the sleeve to become lodged in position. At times, hydraulic pressure is applied from the outlets back into a sealed annulus between the tubing head and the outer diameter of the isolation sleeve to cause the isolation sleeve to be forced partially upward and push the sleeve partially out of the fracturing adapter and/or tubing head, or other devices of the wellhead assembly. However, as soon as the seals extend beyond the sealed internal bore, the pressure dissipates and can longer be used as a medium to continue pushing out the isolation sleeve. Thus, the force to remove the remainder of the isolation sleeve can become a challenge when a drilling rig is not present when the sleeve has to be removed manually.

The complexities are extended when different wells have different wellhead assembly stack heights due to different pressure ratings. Different isolation sleeves even of the same diameter are sometimes used at well sites to accommodate the different stack heights due to the different pressure ratings of the wellhead assembly.

Therefore, there remains a need to provide an improved system and method that can reliably remove an isolation sleeve and is adapted to accommodate various spacings of devices used in the wellhead assembly.

BRIEF SUMMARY

The disclosure provides a fracturing isolation sleeve for a wellhead assembly including a fracturing adapter and tubing head. In at least one embodiment, the sleeve can telescope to different lengths to fit different assemblies without necessitating switching the sleeve or portions thereof. The sleeve can be coupled to the wellhead assembly by threaded and non-threaded connections. The sleeve upper portion can be threadably engaged with the wellhead assembly, and/or the sleeve lower portion can be threadably engaged with a packoff bushing rotationally coupled to the wellhead assembly through an anti-rotation mechanism. Further, the sleeve can include a retaining nut to be threadably engaged with the wellhead assembly without necessarily rotating the sleeve upper or lower portions. The sleeve can be also coupled with the wellhead assembly through a mandrel coupled to the sleeve having an actuating cam surface to actuate a lock ring with the wellhead assembly.

The disclosure provides a fracturing isolation sleeve for sealing an internal portion of a wellhead assembly for a well, the assembly having at least one wellhead device with an internal bore, comprising: an upper sleeve portion having an internal bore; and a lower sleeve portion having an internal bore and coupled with the upper sleeve portion and adapted to be telescopically coupled to the upper sleeve portion at an expandable joint to selectively establish different total lengths of the combination of the upper sleeve portion and the lower sleeve portion, the isolation sleeve being sized to fit within the internal bore of at least the one wellhead device and adapted to be selectively coupled to at least the wellhead device.

The disclosure also provides a fracturing isolation sleeve for sealing an internal portion of a wellhead assembly for a well, the assembly having at least one wellhead device with an internal bore, comprising: an upper sleeve portion having an internal bore; a lower sleeve portion having an internal bore and coupled with the upper sleeve portion, the isolation sleeve being sized to fit within the internal bore of at least the one wellhead device and adapted to be selectively coupled to at least the wellhead device; and a sleeve retention mechanism coupled to the upper sleeve portion to hold the isolation sleeve in relative longitudinal position to the wellhead device, the sleeve retention mechanism adapted to be actuated independent of a rotation of the upper sleeve portion.

The disclosure further provides a fracturing isolation sleeve for sealing an internal portion of a wellhead assembly for a well, the wellhead assembly comprising a wellhead device with a packoff bushing rotationally coupled to a lower portion of the wellhead device, comprising: an upper sleeve portion having an internal bore; and a lower sleeve portion having an internal bore and coupled with the upper sleeve portion, the lower sleeve portion comprises an engagement surface adapted to engage the packoff bushing and hold the sleeve portion in relative longitudinal position to the packoff bushing.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Figure 1:
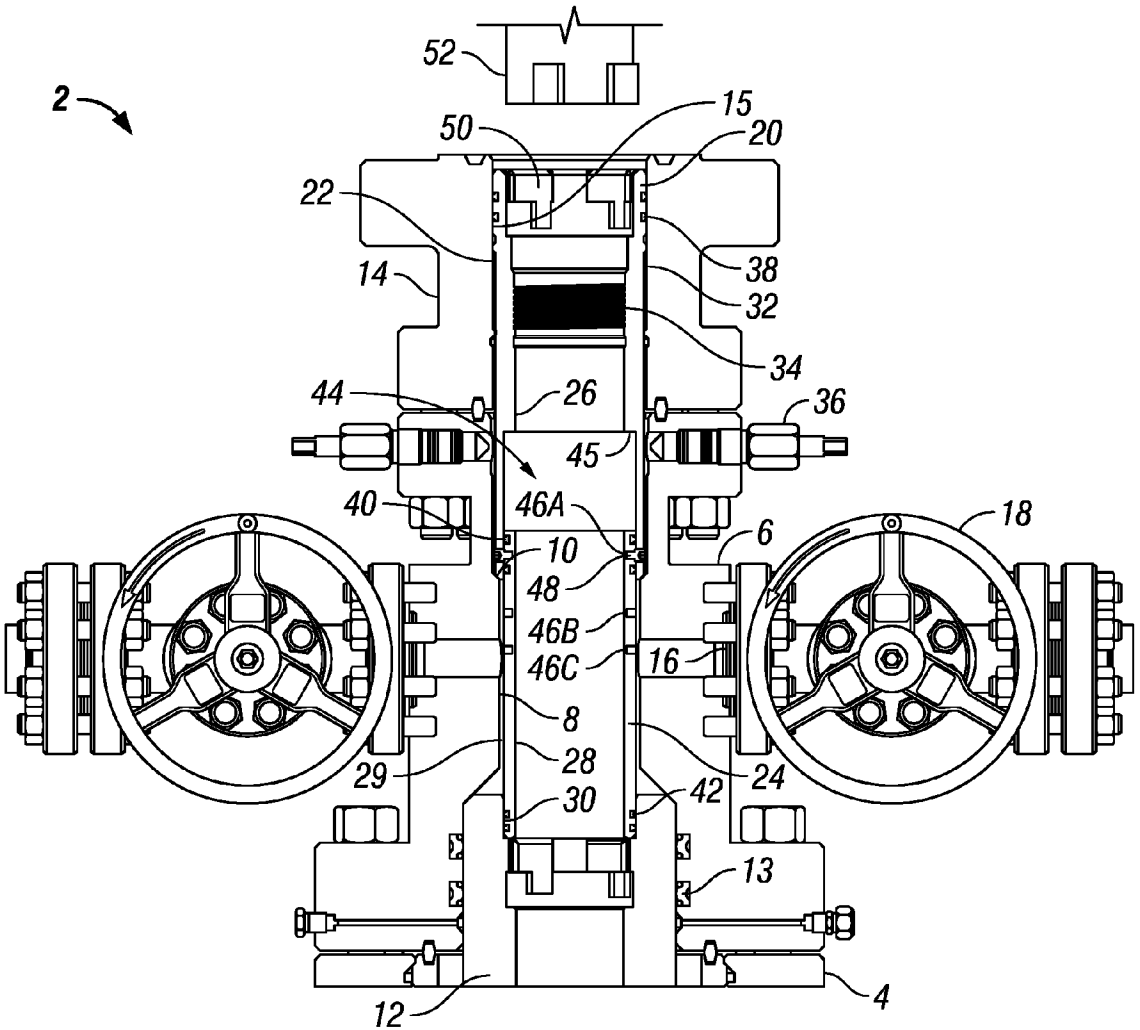
FIG. 1 is a schematic cross-sectional side view of a wellhead assembly having an isolation sleeve according to the present disclosure.
Figure 2:
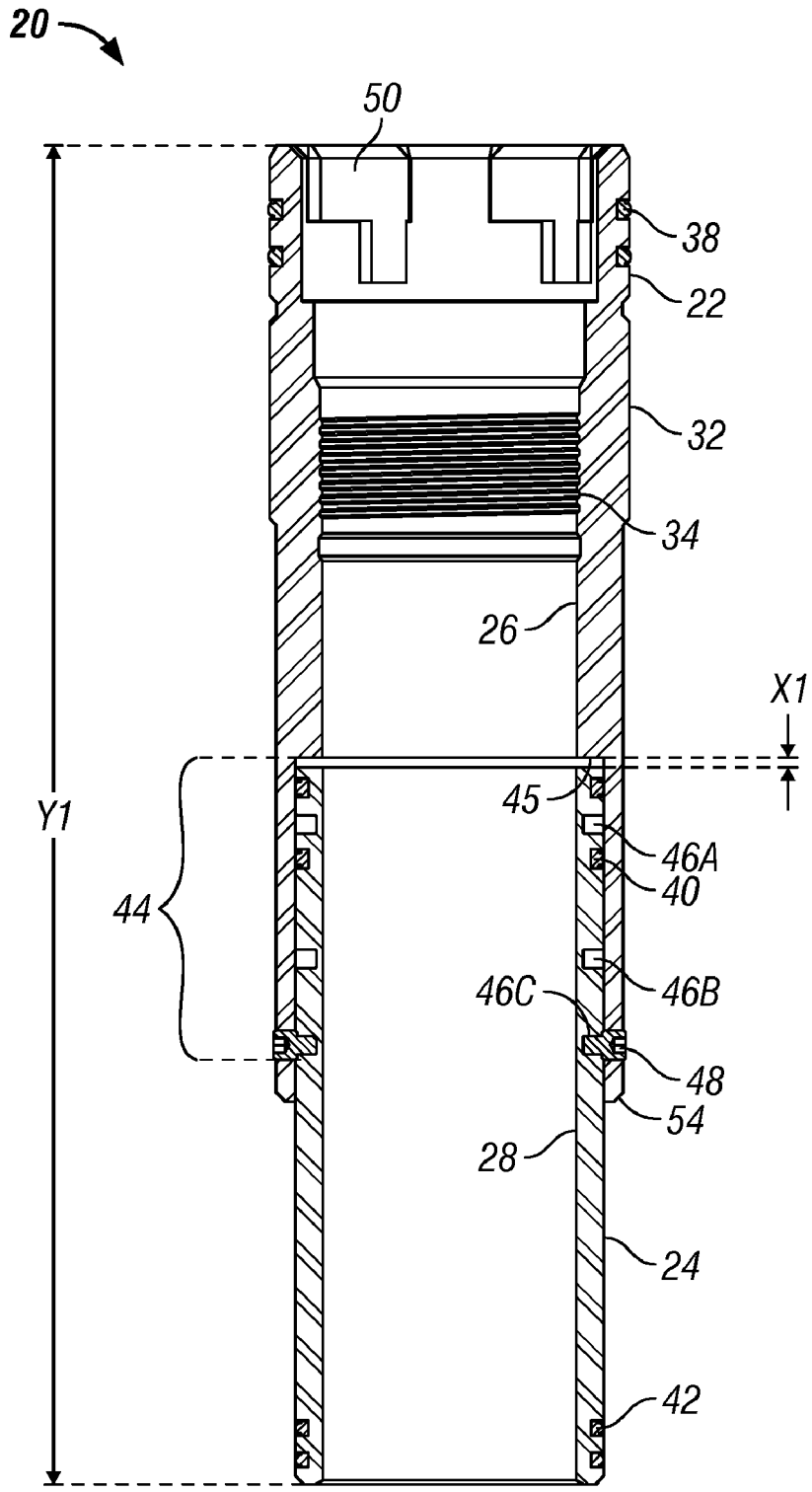
FIG. 2 is a detail of the isolation sleeve shown in FIG. 1 with a minimum selected sleeve length.
Figure 3:
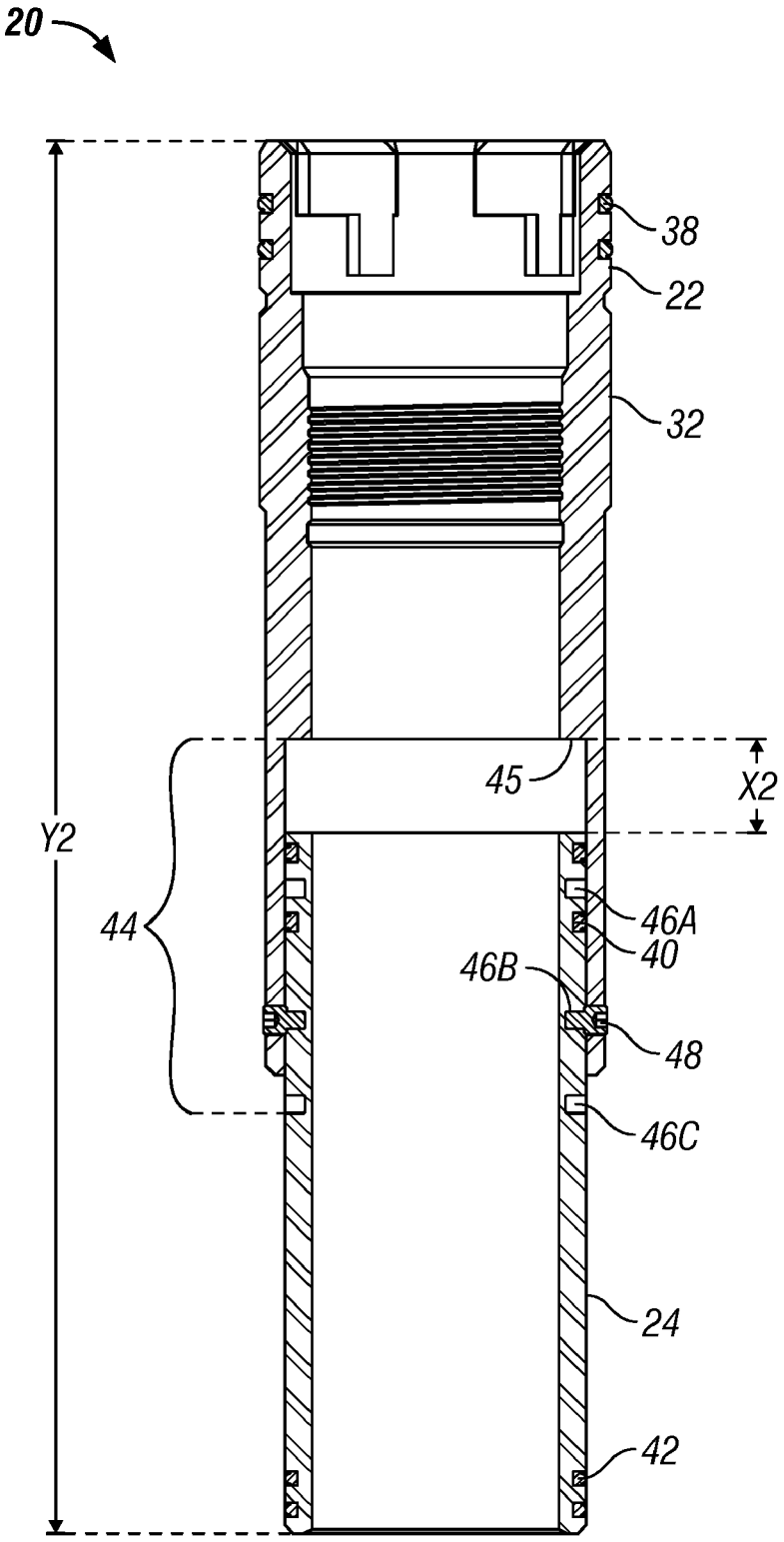
FIG. 3 is a detail of the isolation sleeve shown in FIG. 1 with an intermediate selected sleeve length.
Figure 4:
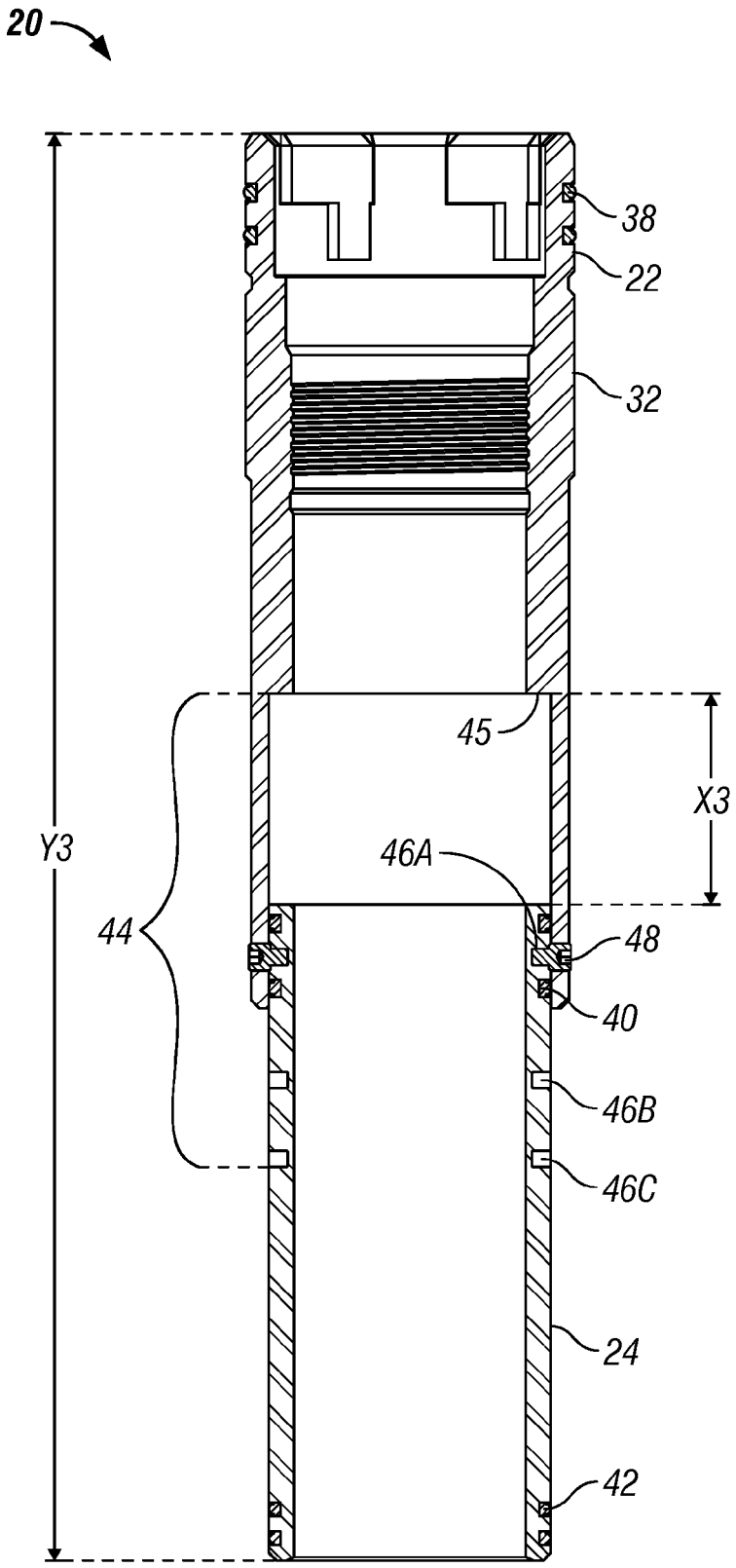
FIG. 4 is a detail of the isolation sleeve shown in FIG. 1 with a maximum selected sleeve length.

FIG. 1 is a schematic cross-sectional side view of a wellhead assembly having an isolation sleeve according to the present disclosure. FIG. 2 is a detail of the isolation sleeve shown in FIG. 1 with a minimum selected sleeve length. FIG. 3 is a detail of the isolation sleeve shown in FIG. 1 with an intermediate selected sleeve length. FIG. 4 is a detail of the isolation sleeve shown in FIG. 1 with a maximum selected sleeve length. The figures will be described in conjunction with each other. The wellhead assembly 2 generally includes a stack of components above a well for the production of hydrocarbons, such as oil and natural gas. In general, the well will include a series of one or more diameters of casings inserted into the various strata of the well to which the wellhead assembly is attached at the surface. A casing head 4 with an internal bore is generally attached to the top of the well. A casing hangar (shown for example in FIG. 7) is disposed in the casing head 4 to support the casing disposed therefrom. A tubing head 6 is coupled to the casing head 4. The tubing head is formed with an internal bore 8 and a landing shoulder 10 that can be used to support the isolation sleeve described below. A restricted packoff bushing 12 is disposed longitudinally at least partially between the tubing head 6 and the casing head 4 in their internal bores. The packoff bushing 12 includes a packoff bushing seal 13 to isolate the annular spaces in the tubing head from the casing head and the casing below. The tubing head includes one or more outlets 16 that are controlled by one or more valves 18. Production fluids travel into the casing and then into production tubing disposed in the casing, and upward into the wellhead assembly 2, including the tubing head 6 and through the outlet 16 and the valves 18.

A fracturing operation is sometimes beneficial to enhance production from the well. For such operations, generally, a fracturing adapter 14 having an internal bore 15 can be coupled above the tubing head 6. One or more wellhead devices, such as a blowout preventer (not shown) and other equipment, can be coupled above the fracturing adapter. An isolation sleeve 20 can be inserted through the one or more devices and into the fracturing adapter to a predetermined position and can extend at least partially into the tubing head to protect components therein. In the embodiment shown, the isolation sleeve 20 can be disposed into the bore of the fracturing adapter 14 and extend downward through the tubing head 6 and seal into the restricted packoff bushing 12. The isolation sleeve 20 is sized and designed to be removable through the fracturing adapter 14 and the blowout preventer or other wellhead device above the fracturing adapter 14. Such capabilities minimize disassembly after the fracturing process for later operations.

The isolation sleeve 20 generally includes the upper portion 22 having an internal bore 26 and a lower portion 24 likewise having an internal bore 28. An external surface 29 of the sleeve 20 can sealably engage the internal bore 30 of the packoff bushing. The sleeve 20 will generally be coupled to one or more members of the wellhead assembly in an operating position. In at least one embodiment, an engagement surface 32, such as threads, lock ring, and other forms of engagement, can be formed between the sleeve 20 and the wellhead device to which the sleeve is coupled. In at least one embodiment, the engagement surface 32 can include threads formed on the external surface 29 of the isolation sleeve 20 that can engage mating threads formed on the internal bore 15 of the fracturing adapter 14.

Figure 13:
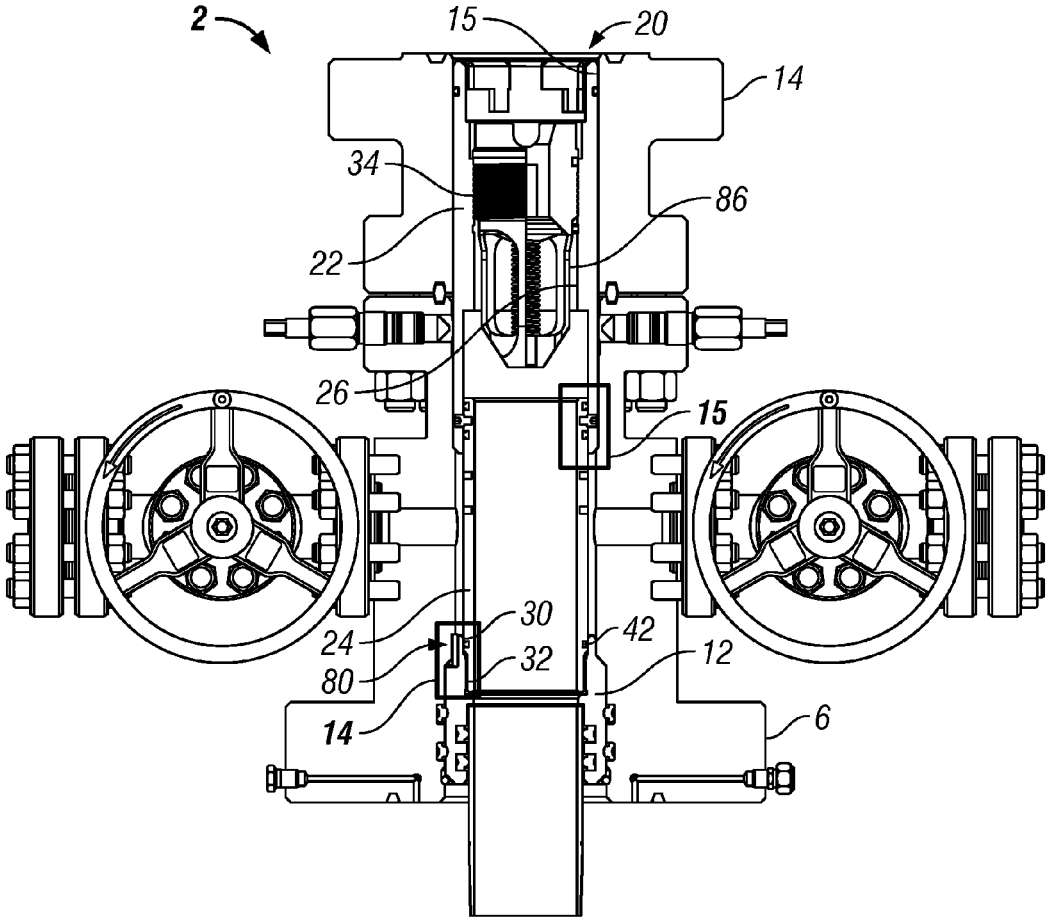
FIG. 13 is a cross-sectional schematic side view of the embodiment of FIG. 12 showing flow restrictor disposed internal to the isolation sleeve.

Turning briefly to FIG. 13, the internal bore of the sleeve 20, such as the internal bore 26 of the upper portion 22, can include an internal engagement surface 34 for a flow restrictor 86, such as a back pressure valve, as is known to those with ordinary skill in the art. Such a valve or other flow restrictor is useful during the fracturing process to control any pressurized production fluids that occur during the fracturing process. The flow restrictor can include threads and the engagement surface 34 can have corresponding mating threads.

Returning to FIG. 1, one or more lock down pins 36 are disposed through the wall of the tubing head 6 for coupling various internal devices to the tubing head 6, as is known to those with ordinary skill in the art, including some isolation sleeves. However, the isolation sleeve 20 of the present disclosure can operate independent of the lock down pins 36.

To isolate the pressures in the fracturing process, an exterior surface of the isolation sleeve 20 can include an upper seal 38 disposed in the upper portion 22 of the isolation sleeve to sealably engage the surrounding bore of the fracturing adapter 14 or other wellhead device coupled with the isolation sleeve seal. Further, the isolation sleeve 20 can include a lower seal 42 disposed in the external surface 29 of the sleeve 20 that can sealably engage the internal bore 30 of the packoff bushing.

In at least one embodiment, the sleeve 20 can include an expandable joint 44. The expandable joint 44 can allow relative longitudinal movement between the upper portion 22 of the sleeve 20 and the corresponding lower portion 24 of the sleeve. The expandable joint 44 allows the lower sleeve portion to telescopically engage the upper sleeve portion, so that the overall total length of the sleeve 20 can be selectively varied depending on the needs and stack height of the wellhead assembly. The lower sleeve portion can include one or more adjustment openings, such as 46A, 46B, 46C, generally referenced herein as opening(s) 46. The openings 46 can cooperate with a retainer 48 disposed, for example, in the upper sleeve portion 22. By selectively engaging the retainer 48 with the particular adjustment opening 46, different total lengths of the isolation sleeve 20 can be obtained. The arrangement can be reversed, so that the opening 46 can be disposed in an internal surface of the upper sleeve portion 22 and the retainer 48 disposed in an external surface of the lower sleeve portion 24.

A sleeve seal 40 can be disposed between the upper and lower sleeve portions to maintain the integrity of the overall sealing between the internal surfaces of the isolation sleeve 20 and the wellhead assembly. The expandable joint can also include a stop shoulder 45 that restricts the minimum length of the sleeve 20, where the stop shoulder 45 can be formed on the upper sleeve portion 22. The stop shoulder 45 and the corresponding upper edge of the lower sleeve portion can include tapers (not shown) to facilitate tools and other devices being smoothly inserted through the internal bore of the sleeve.

In other embodiments, the sleeve 20 can be a unitary piece, such that the upper sleeve portion and lower sleeve portion are fixedly coupled to each other or integral therewith. In such instances, the terms upper sleeve portion and lower sleeve portion are used to refer to zones of the sleeve 20, rather than specific discrete elements of the sleeve 20.

To facilitate installation and removal of the sleeve 20 from the wellhead assembly, one or more tool latching profiles 50 can be formed in the isolation sleeve 20. A generally acceptable profile could include a "J"-type or "L"-type profile with a corresponding tool 52 that can be inserted into the sleeve. If threads are used on the engagement surface 32, then the tool 52 can rotate the sleeve 20 clockwise or counterclockwise to threadably engage and disengage the isolation sleeve from the wellhead assembly 2.

Figure 15:
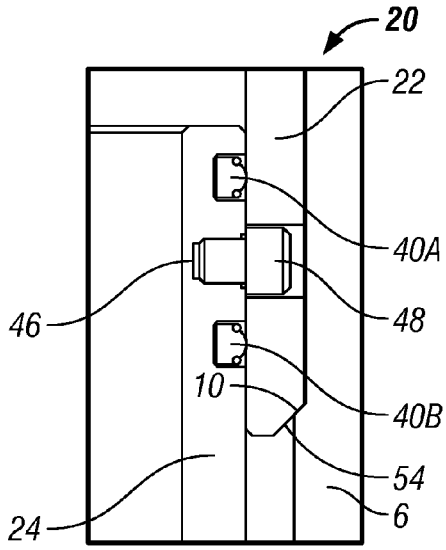
FIG. 15 is a detailed schematic cross-sectional side view of the sleeve seated on a shoulder of the wellhead assembly.

Turning briefly to details of the seating of the sleeve 20 in the wellhead assembly 2, FIG. 15 is a detailed schematic cross-sectional side view of the sleeve seated on a shoulder of the wellhead assembly. The isolation sleeve 20 can be longitudinally positioned in the wellhead assembly, such as the tubing head 6. The shoulder 10 in the tubing head 6 or other wellhead device can be adapted to receive a corresponding landing surface 54 formed on a portion of the isolation sleeve 20 to restrict a lower limit of travel in the internal bore of the wellhead assembly. The landing surface 54 can be formed on an end portion of the upper sleeve portion 22 or other appropriate surface to restrict the movement of the sleeve in the internal bores of the wellhead assembly devices.

As described above, the sleeve seal 40 (and other seals 28, 42) can include one or more seals, such as seal 40A and 40B. Thus, the use of the singular for the term "seal" is intended to mean at least one seal. The retainer 48 can be threadably coupled with threads formed in the opening 46 of the lower sleeve portion 24, so that a head of the retainer extends through an opening in the upper sleeve portion 22 to restrict the relative longitudinal movement of the upper and lower sleeve portions. Alternatively, the retainer 48 can be threadably or otherwise coupled to the upper sleeve portion 22 and the retainer simply extend outwardly into the opening 46 of the lower sleeve portion. Other variations are contemplated.

Referencing FIG. 2, if the retainer 48 is engaged with the adjustment opening 46C, the sleeve portions are disposed in close proximity to each other to establish a minimum adjustment gap X1 which may be zero in length, and a minimum sleeve length Y1. Referencing FIG. 3, if the intermediate adjustment opening 46B is selected, so that the retainer 48 engages the opening 46B, then an intermediate adjustment gap X2 is established, resulting in an intermediate sleeve length Y2. Referencing FIG. 4, if the adjustment opening 46A is engaged with the retainer 48, then a maximum selectable adjustment gap X3 is established, resulting in a maximum selectable sleeve length Y3. Naturally, the number of openings 46 can vary as well as the number of retainers 48, both longitudinally and peripherally around the sleeve portions. While the openings are shown in discreet increments, it is contemplated that the openings could be slots, either peripherally or spirally formed, such that the total sleeve length and adjustment gap could be incrementally variable within acceptable ranges of the sleeve for various wellhead assemblies.

Figure 5A:
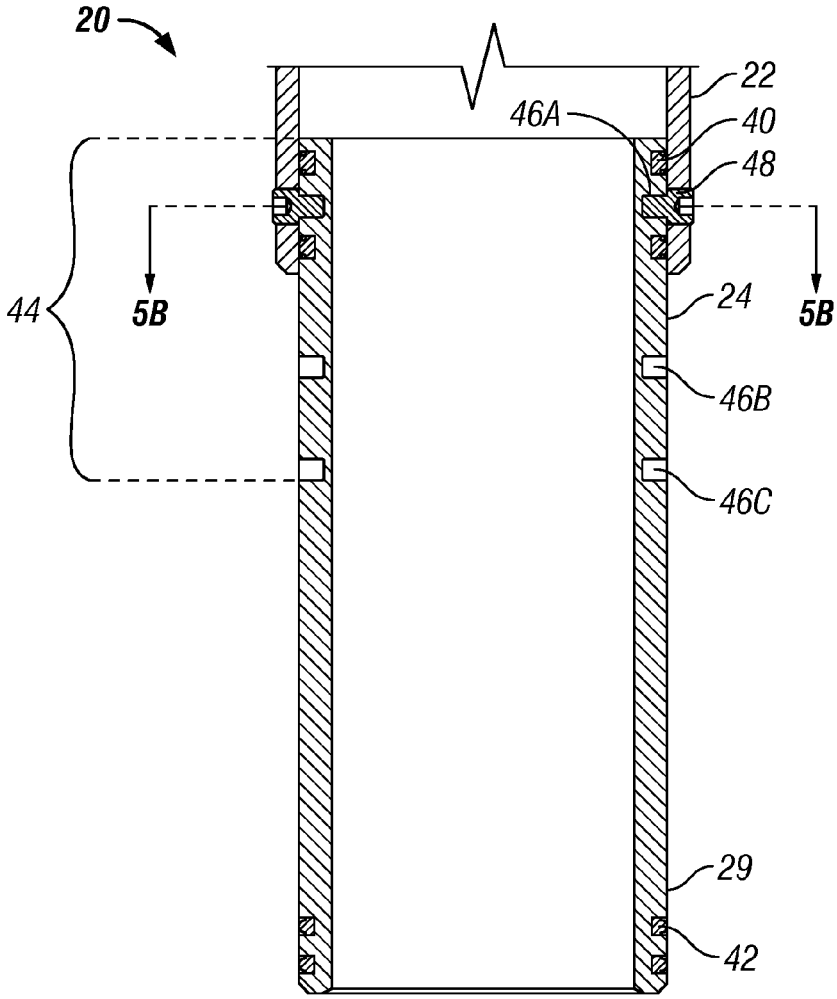
FIG. 5A is a detailed schematic cross-sectional side view of the expansion joint.
Figure 5B:
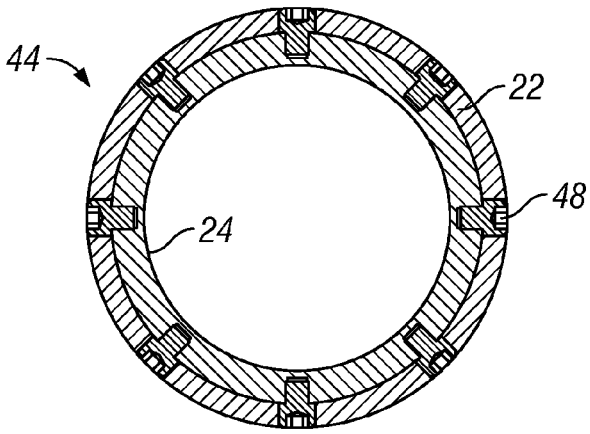
FIG. 5B is a detailed schematic cross-sectional top view through FIG. 5A.

FIG. 5A is a detailed schematic cross-sectional side view of the expansion joint. FIG. 5B is a detailed schematic cross-sectional top view through FIG. 5A. The figures will be described in conjunction with each other. The expansion joint 44 generally includes a region of the isolation sleeve 20 that allows the upper sleeve portion 22 to be telescopically engaged with the lower sleeve portion 24. In at least one embodiment, one or more openings 46A, 46B, 46C can be formed in the lower sleeve portion 24 to engage a retainer 48 disposed in the upper sleeve portion 22. For example, the retainer 48 can be a threaded Allen screw or other appropriate fastener that can threadably engage a suitable opening through the wall of the upper sleeve portion 22, so that it extends inwardly and engages the opening 46. Alternatively, the threads can be formed in the opening 46 of the lower sleeve portion, so that the head of the retainer extends into an opening formed in the upper sleeve portion to longitudinally couple the sleeve portions together. A plurality of the retainers 48 can be disposed around the periphery of the expansion joint 44 to secure the sleeve portions in the appropriate relative position. The sleeve seal 40 can sealably engage the surfaces of the upper and lower sleeve portions. Similarly, the lower seal 42 can be disposed on an external surface 29 of the lower sleeve portion 24 to sealably engage a device of the wellhead assembly, such as packoff bushing 12 shown in FIG. 1.

Figure 6:
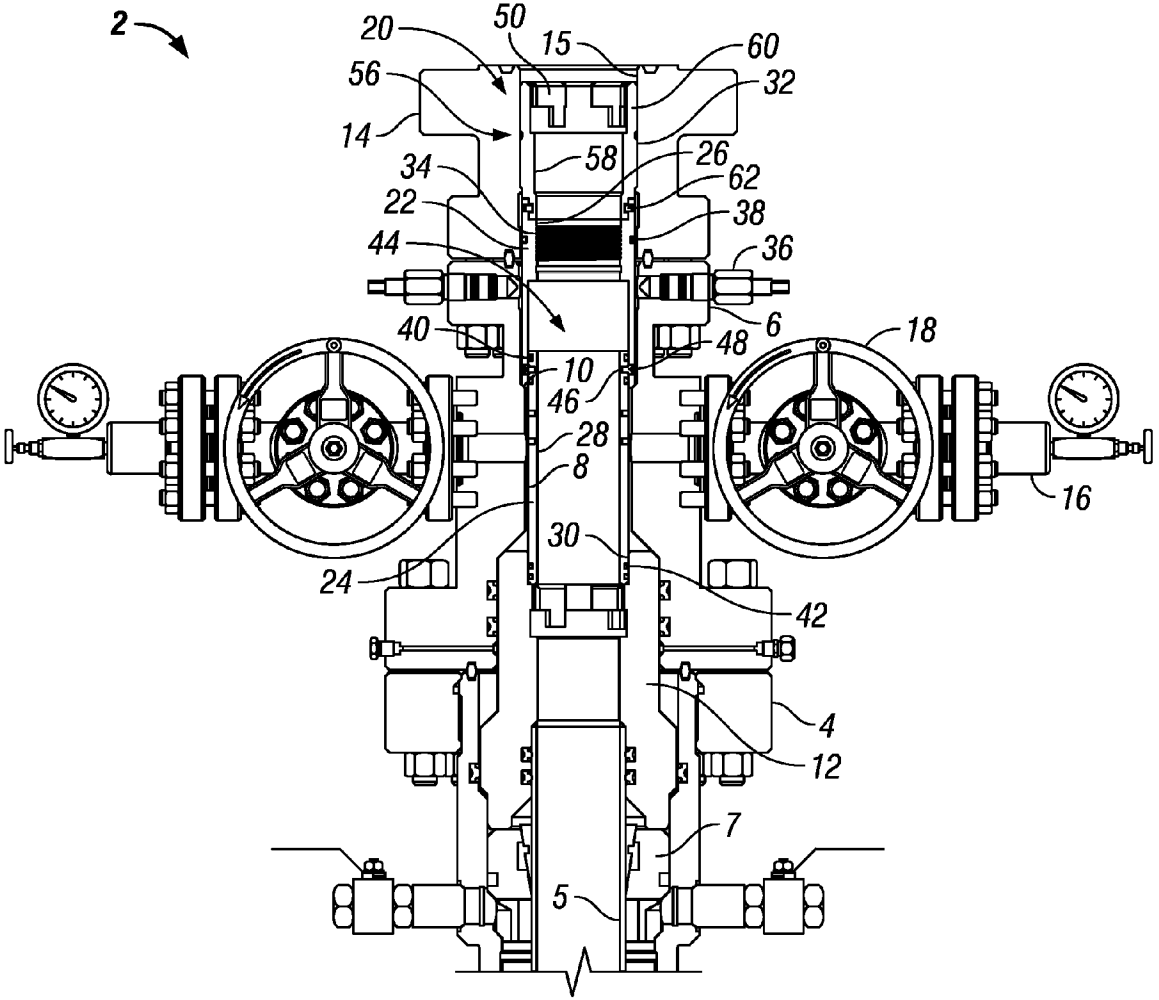
FIG. 6 is a schematic cross-sectional side view of a wellhead assembly having another embodiment of the isolation sleeve disposed therein.
Figure 7:
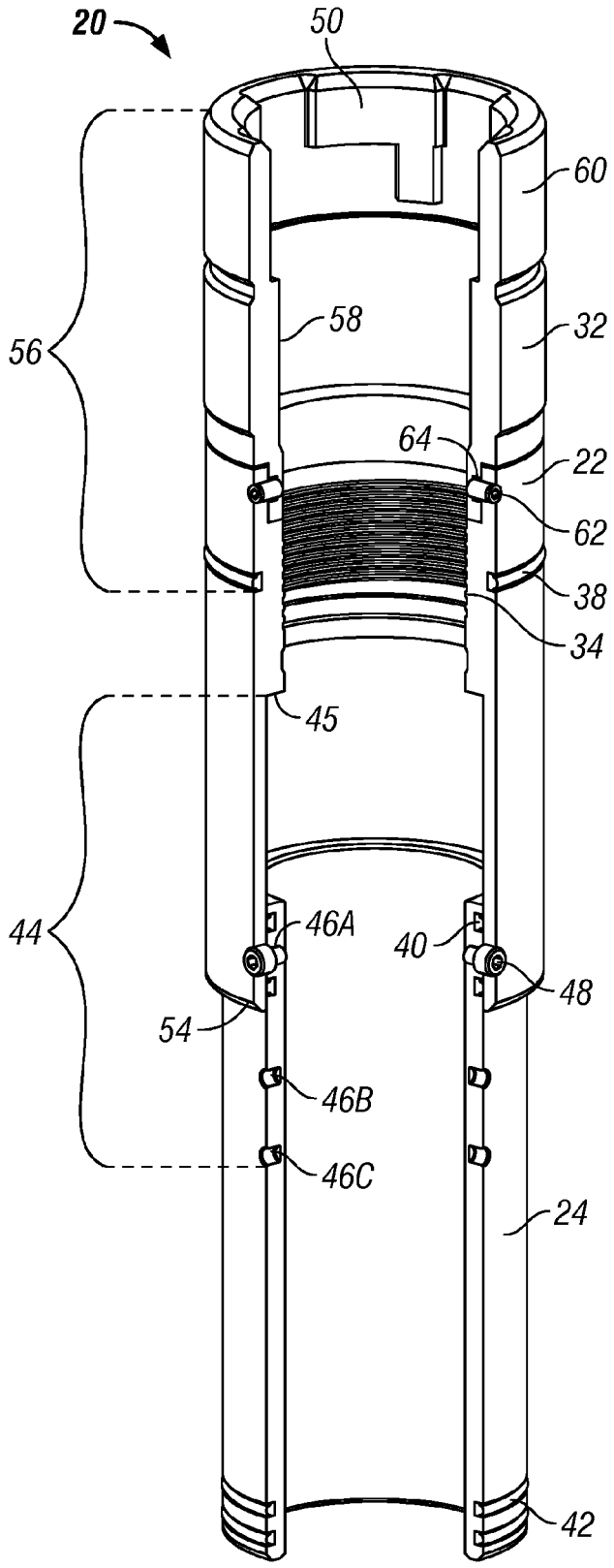
FIG. 7 is a schematic perspective cutaway view of the isolation sleeve shown in FIG. 6.
Figure 8:
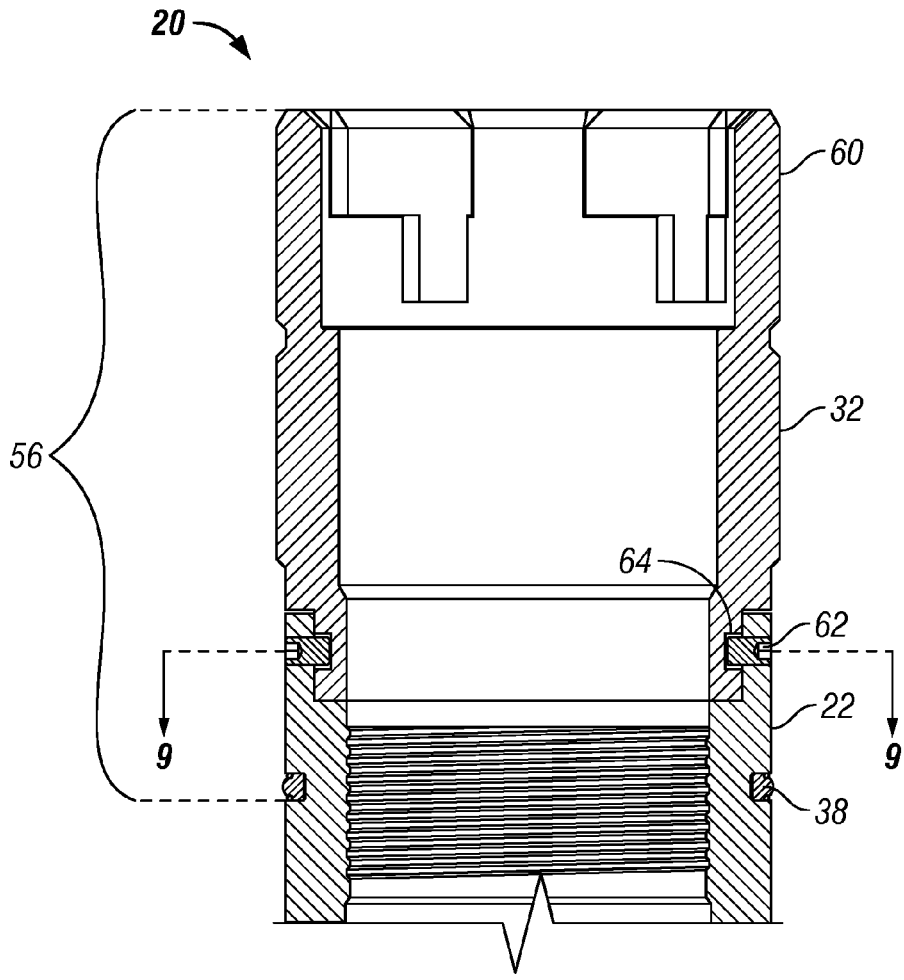
FIG. 8 is a detailed schematic cross-sectional side view of an upper section of the isolation sleeve shown in FIG. 7.
Figure 9:
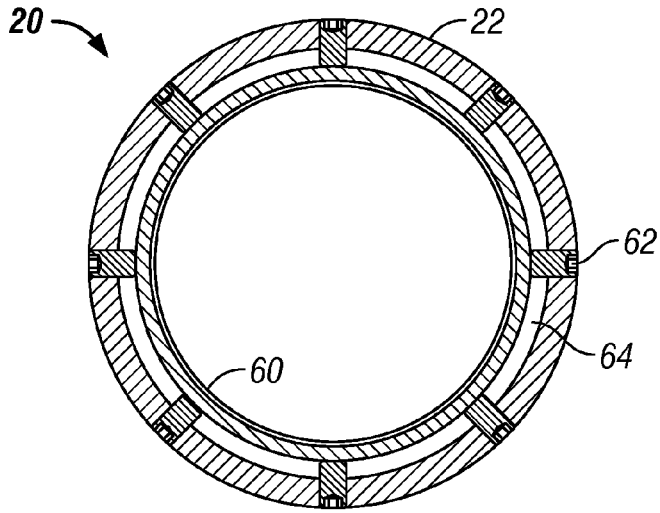
FIG. 9 is a detailed schematic cross-sectional top view of a section through FIG. 8.

FIG. 6 is a schematic cross-sectional side view of a wellhead assembly having another embodiment of the isolation sleeve disposed therein. FIG. 7 is a schematic perspective cutaway view of the isolation sleeve shown in FIG. 6. FIG. 8 is a detailed schematic cross-sectional side view of an upper section of the isolation sleeve shown in FIG. 7. FIG. 9 is a detailed schematic cross-sectional top view of a section through FIG. 8. The figures will be described in conjunction with each other. The wellhead assembly 2 generally includes the wellhead devices described above. In addition to the previously described wellhead devices, a casing 5 is shown that engages a lower section of the packoff bushing 12 described above. A casing hangar 7 is disposed about a portion of the casing 5 to couple the casing to the wellhead assembly 2, and particularly the casing head 4. Further, as described above, the isolation sleeve 20 can include an expandable joint 44, or the isolation sleeve can be of a fixed height such that the upper sleeve portion 22 and lower sleeve portion 24 form an integral unit of a fixed length.

The sleeve 20 generally includes an upper sleeve portion 22 and a lower sleeve portion 24 coupled to one or more wellhead devices described above. In at least one embodiment, the isolation sleeve 20 further includes a sleeve retention mechanism 56 coupled to the upper sleeve portion 22. For example, the sleeve retention mechanism 56 can include a retaining nut 60 having an internal bore 58. The retaining nut 60 is longitudinally coupled to the upper and/or lower sleeve portions, so that when the retaining nut is engaged with the wellhead assembly, the isolation sleeve is also retained thereto. The retaining nut 60 is adapted to be coupled to the fracturing adapter 14 and can rotate independently of the upper sleeve portion 22 and the lower sleeve portion 24. Thus, O-ring seals and other seals may be subjected to less wear by allowing the retaining nut to be rotated into an engagement with the fracturing adapter 14 or other wellhead device without necessarily rotating the upper and lower sleeve portions.

Referring more specifically to FIGS. 7, 8, and 9, the sleeve retention mechanism 56 generally includes the retaining nut 60 having an engagement surface 32 formed on an external surface of the retaining nut 60. The engagement surface, as described above, can include threads, a lock ring, or other coupling element. The retaining nut 60 can be coupled to the upper sleeve portion 22 by a retainer 62 engaging a groove 64. In this particular embodiment, the groove can be a peripheral groove 64 that extends substantially around the outer periphery of the retaining nut portion 60 disposed adjacent the upper sleeve portion 22. The retainer 62 and the groove 64 can allow the independent rotation of the retaining nut 60 without requiring a corresponding rotation of the upper sleeve portion 22, and yet still longitudinally retain the retaining nut 60 with the upper sleeve portion. A plurality of retainers 62 can be spaced about the periphery of the upper sleeve portion 22 to slidably engage the groove 64.

Figure 10:
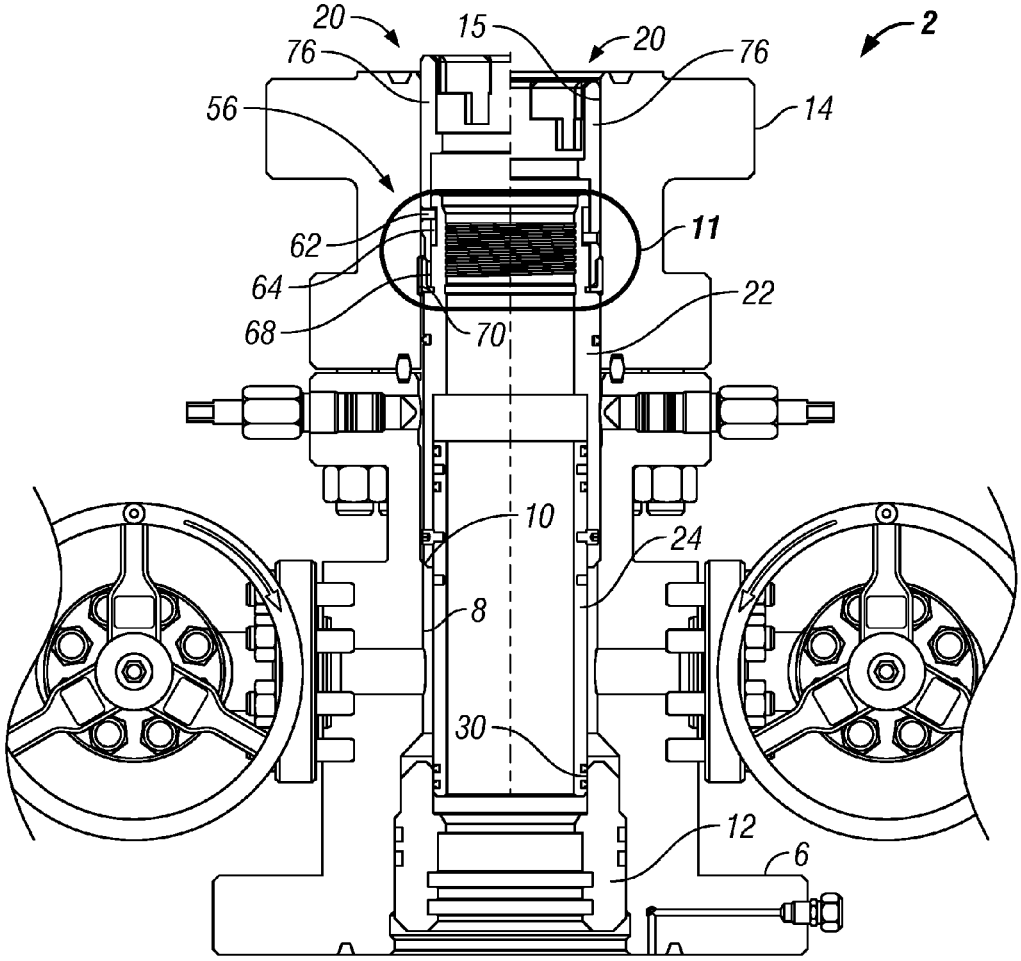
FIG. 10 is a schematic cross-sectional side view of another embodiment of the sleeve disposed in a wellhead assembly.
Figure 11:
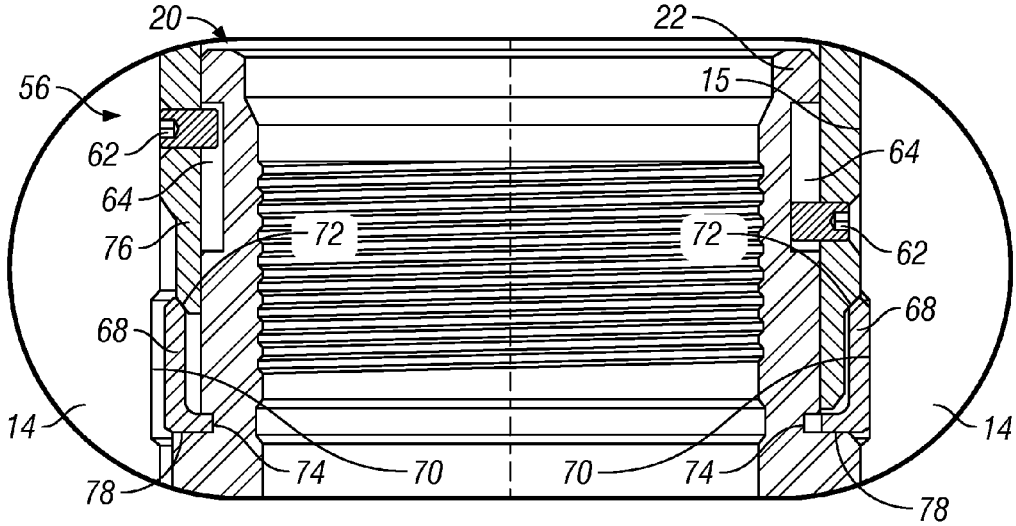
FIG. 11 is a detailed schematic cross-sectional side view of a portion of the sleeve retention mechanism shown in FIG. 10.

FIG. 10 is a schematic cross-sectional side view of another embodiment of the sleeve disposed in a wellhead assembly. FIG. 11 is a detailed schematic cross-sectional side view of a portion of the sleeve retention mechanism shown in FIG. 10. The drawings will be described in conjunction with each other. Various devices of the wellhead assembly have been described herein, such as the tubing head 6 with a packoff bushing 12 and a fracturing adapter 14 disposed above the tubing head. The left half of FIG. 10 shows the isolation sleeve in a disengaged and decoupled condition with the fracturing adapter 14 or other wellhead device as may be the case, while the right half of FIG. 10 shows the isolation sleeve in an engaged condition.

This embodiment includes a sleeve retention mechanism 56 having an actuator mandrel 76 with an energizing actuator 72 formed on an end of the mandrel. The energizing actuator 72 can be a tapered surface that functions as an energizing cam, which can engage a corresponding surface on a lock ring 68 described herein. The actuator mandrel 76 can be coupled to the upper sleeve portion 22 by a retainer 62 disposed in a groove 64. A plurality of retainers 62 spaced around the periphery of the mandrel 76 can be used to engage the groove 64. The groove 64 would be a longitudinal groove that allows the actuator mandrel 76 to operate within a predetermined length relative to the upper sleeve portion 22. The groove 64 can be formed in the upper sleeve portion 22 and the retainer 62 can be formed in the actuator mandrel 76. Other arrangements are contemplated such that the groove 64 can be formed in the mandrel 76 and the retainer 62 be coupled to the upper sleeve portion 22.

The lock ring 68 can be a split lock ring, such that the lock ring is normally disposed at a particular diameter and can be contracted or expanded depending on which surface the actuator 72 engages. In the particular embodiment, the actuator 72 is sized and shaped to engage an inner tapered surface of the lock ring 68, so that as the mandrel moves downward, the lock ring 68 is expanded outward from the sleeve 20. The expansion of the lock ring can engage a corresponding locking groove 70 formed in the fracturing adapter 14 or other wellhead device. Further, the lock ring 68 can be slidably coupled to the upper sleeve portion 22, so that when the lock ring 68 is engaged with the locking groove 70 in the wellhead, the upper sleeve portion 22 is also longitudinally coupled to the wellhead assembly. Specifically, the lock ring 68 can include a ring retainer portion 78 that extends inwardly from the lock ring body into a corresponding groove 74 in the upper sleeve portion 22. Other configurations are contemplated, such as the lock ring 68 being in a normally expanded configuration and being actuated by the actuator 72 in an inwardly direction toward the upper sleeve portion 22 and couples the sleeve with the wellhead assembly, such as the fracturing adapter 14. It is also contemplated that the mandrel 76 can be coupled to an inside surface of the isolation sleeve 22 instead of the external surface of the upper sleeve portion 22.

In operation, when the mandrel 76 is in an upward position, as shown in the left half of FIG. 10, the lock ring 68 and the isolation sleeve is disengaged from the wellhead assembly and the isolation sleeve can be inserted or removed from the wellhead assembly. When the actuator mandrel 76 is moved in a downward position relative to the upper sleeve portion 22, as shown in the right half of FIG. 10, the lock ring 68 is disposed outwardly into the groove 70 of the wellhead and the isolation sleeve 20 is locked in position relative to the wellhead assembly.

Thus, the sleeve retention mechanism 56, through the actuator mandrel 76, can be actuated independently of a rotation of the upper sleeve portion. Further, the sleeve retention mechanism can actuate the lock ring to secure the sleeve into position with the fracturing adapter 14, independently of movement of the sleeve by use of the longitudinal groove 64 after the sleeve portion is seated on the shoulder 10 of the tubing head 6.

Figure 12:
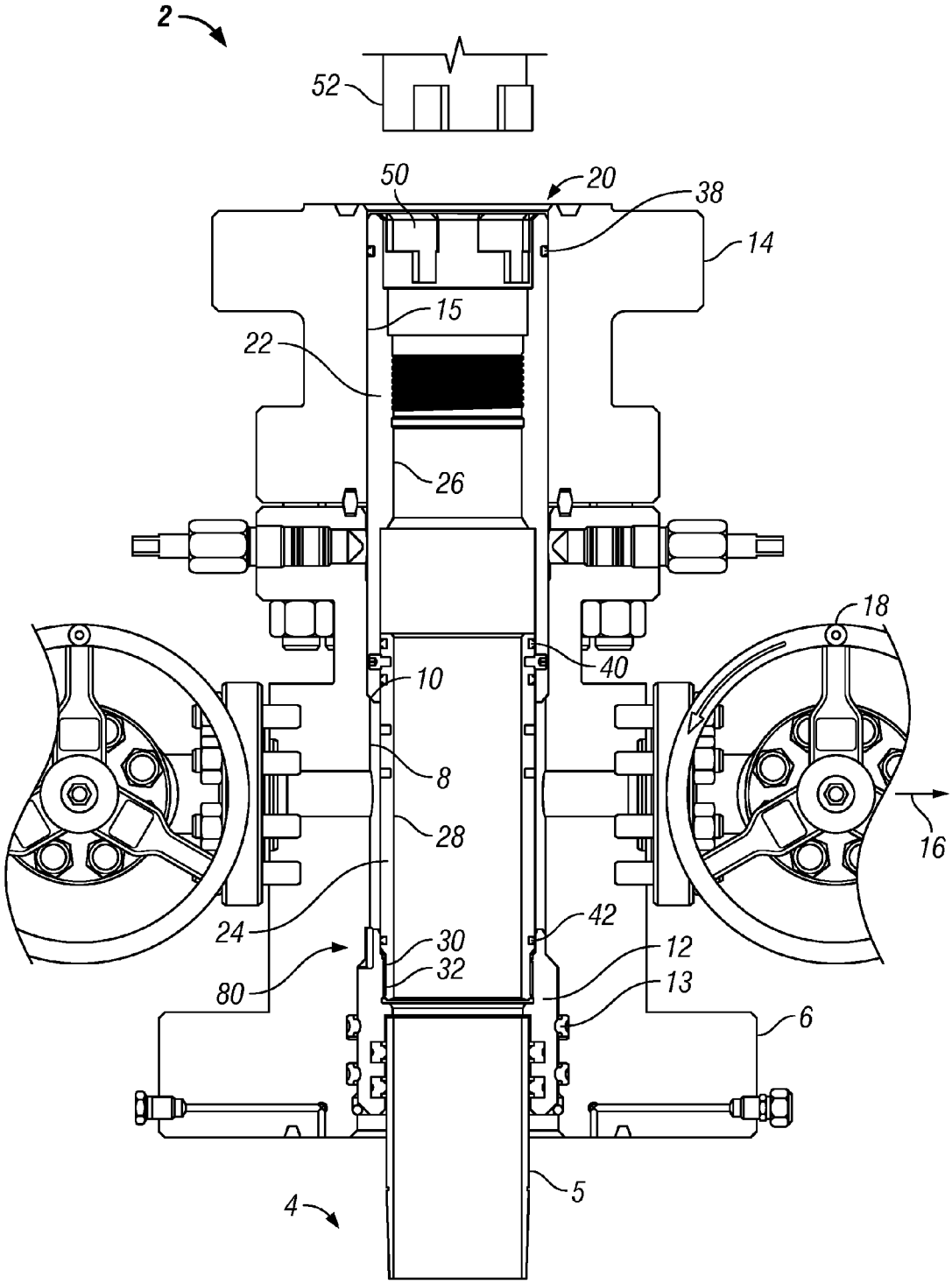
FIG. 12 is a schematic cross-sectional side view of another embodiment of the isolation sleeve in the wellhead assembly.
Figure 14:
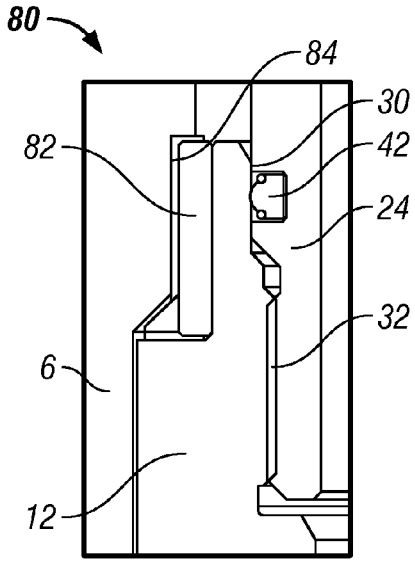
FIG. 14 is a detailed schematic cross-sectional side view of an anti-rotation mechanism shown in FIGS. 12 and 13.

FIG. 12 is a schematic cross-sectional side view of another embodiment of the isolation sleeve in the wellhead assembly. FIG. 13 is a cross-sectional schematic side view of the embodiment of FIG. 12 showing flow restrictor disposed internal to the isolation sleeve 20. FIG. 14 is a detailed schematic cross-sectional side view of an anti-rotation mechanism shown in FIGS. 12 and 13. The figures will be described in conjunction with each other. Various wellhead devices and sleeve elements have been described herein. In this embodiment, the isolation sleeve 20 can be coupled to a wellhead device of the wellhead assembly in a lower portion of the isolation sleeve 20. For example, the isolation sleeve 20 can include an engagement surface 32 on the lower sleeve portion 24 that threadably engages mating threads on the internal bore 30 of the packoff bushing 12. Thus, the isolation sleeve can be inserted through the tubing adapter 14, travel through at least a portion of the tubing head 6 down to the packoff bushing 12. If the engagement surface 32 includes threads, then the tool 52 can be used to engage the tool latching profile 50 and rotate the isolation sleeve to engage the threads of the packoff bushing 12. Generally, the rotation can be of sufficient turns to allow the isolation sleeve to engage the shoulder 10 on the tubing head 6. The isolation sleeve can utilize the above described upper seal 38 and the lower seal 42, and, if appropriate, the sleeve seal 40 in conjunction with an expandable joint 44.

An anti-rotation mechanism 80 can be formed for the coupling of the packoff bushing 12 with the tubing head 6. The anti-rotation mechanism 80 can assist in retaining the packoff bushing 12 in a fixed position relative to the tubing head 6, so that as the isolation sleeve 20 is rotated into the packoff bushing, the packoff bushing does not unintentionally rotate. The anti-rotation mechanism 80 is further detailed in FIG. 14 and can include an anti-rotation lug 82 formed in the packoff bushing that corresponds to an anti-rotation slot 84 formed in the tubing head 6. The lug and slot configuration can be reversed, so that the slot is in the bushing and the lug is in the tubing head. When the packoff bushing 12 is initially assembled into the tubing head, the lug and slot are aligned and the packoff bushing is inserted into the tubing head. The lug and slot restrict rotation of the packoff bushing to enable the sleeve to be rotated into a threaded coupling with the packoff bushing. Other means of rotationally coupling the packoff bushing 12 to the tubing head 6 are contemplated including spring loaded pins, threaded fasteners, eccentric peripheries, and the other rotation limiting configurations.

FIG. 13 illustrates a flow restrictor 86, such as a back pressure valve, disposed internal to the isolation sleeve 20. It is known in the art to control production fluids in the casing during well completion. A back pressure valve can be used to control the production fluids, if the well develops pressure during the fracturing process. The flow restrictor 86 can also include a check valve, plug, and other devices to restrict flow in one or both directions. The flow restrictor 86 can be coupled into the isolation sleeve by an engagement surface 34, such as threads, lock rings, and the like. In general, the engagement surface will be formed on an external surface of the flow restrictor 86 of the isolation sleeve 20, such as the internal bore 26 of the upper sleeve portion 22.

Other and further embodiments utilizing one or more aspects of the inventions described above can be devised without departing from the spirit of the invention. For example, the threads or lock rings could be located in upper and lower portions of the wellhead devices and/or sleeve, could be disposed on interior and external surfaces, and could sealingly engage all or portions of wellhead devices. Further, the sleeve could be extended to seal into the casing, generally internally in a "stinger" configuration or externally to the casing by appropriate sizing of the sleeve and internal bores of the wellhead devices.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Discussion of singular elements can include plural elements and vice-versa.

Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally. The terms "inward" and "outward" and variations thereof refer to an orientation toward a centerline of an internal bore and away from the centerline of the internal bore, respectively. The terms "upward" and "downward" and variations thereof refer to the orientation shown in the drawing and is not limiting of the actual device or assembly.

The systems and methods herein have been described in the context of various embodiments and not every embodiment has been described. Apparent modifications and alterations to the described embodiments are available to those of ordinary skill in the art. The disclosed and undisclosed embodiments are not intended to limit or restrict the scope or applicability of the concepts of the Applicants, but rather, in conformity with the patent laws, Applicants intend to protect all such modifications and improvements to the full extent that such falls within the scope or range of equivalent of the following claims.

Further, any references mentioned in the application for this patent, as well as all references listed in the information disclosure originally filed with the application, are hereby incorporated by reference in their entirety to the extent such may be deemed essential to support the enabling of the concept. However, to the extent statements might be considered inconsistent with the patenting of the concept, such statements are expressly not meant to be considered as made by the Applicants.

The invention claimed is:

1. A fracturing isolation sleeve for sealing an internal portion of a wellhead assembly for a well, the assembly having at least one wellhead device with an internal bore, comprising:

an upper sleeve portion having an internal bore;

a lower sleeve portion having an internal bore and coupled with the upper sleeve portion and adapted to be telescopically coupled to the upper sleeve portion at an expandable joint to selectively establish different total lengths of the combination of the upper sleeve portion and the lower sleeve portion; and a sleeve retention mechanism coupled to the upper sleeve portion to hold the isolation sleeve in relative longitudinal position to the wellhead device, the sleeve retention mechanism adapted to be actuated independent of a rotation of the upper sleeve portion, wherein the sleeve retention mechanism comprises a retaining nut having an internal bore and threads adapted to mate with corresponding threads on the wellhead device, the retaining nut adapted to be rotated independent of the upper sleeve portion and engage the wellhead device to hold the isolation sleeve in relative longitudinal position to the wellhead device, the isolation sleeve being sized to fit within the internal bore of at least the one wellhead device and adapted to be selectively coupled to at least the wellhead device.

2. The sleeve of claim 1, wherein the retaining nut and the upper sleeve portion are coupled together with at least one retainer engageable with a corresponding peripheral groove.

3. A fracturing isolation sleeve for sealing an internal portion of a wellhead assembly for a well, the assembly having at least one wellhead device with an internal bore, comprising:

an upper sleeve portion having an internal bore;

a lower sleeve portion having an internal bore and coupled with the upper sleeve portion and adapted to be telescopically coupled to the upper sleeve portion at an expandable joint to selectively establish different total lengths of the combination of the upper sleeve portion and the lower sleeve portion, and a sleeve retention mechanism coupled to the upper sleeve portion to hold the isolation sleeve in relative longitudinal position to the wellhead device, the sleeve retention mechanism adapted to be actuated independent of a rotation of the upper sleeve portion, wherein the sleeve retention mechanism comprises a mandrel having an internal bore and an actuating cam surface, the mandrel adapted to actuate longitudinally independent of the upper sleeve portion and cause a lock ring to engage the wellhead device to hold the isolation sleeve in relative longitudinal position to the wellhead device, the isolation sleeve being sized to fit within the internal bore of at least the one wellhead device and adapted to be selectively coupled to at least the wellhead device.

4. The sleeve of claim 3, wherein the mandrel and the upper sleeve portion are coupled together with at least one retainer engageable with a corresponding longitudinal groove.

5. The sleeve of claim 3, wherein the sleeve retention mechanism further comprises a lock ring disposed between an external surface of the isolation sleeve and an internal surface of the bore of the wellhead device and wherein the actuating cam surface of the mandrel is adapted to selectively engage the lock ring.

6. The sleeve of claim 3, wherein the sleeve retention mechanism further comprises a lock ring disposed between an external surface of the isolation sleeve and an internal surface of the bore of the wellhead device and wherein the actuating cam surface of the mandrel is adapted to selectively engage the lock ring, wherein the internal surface of the bore of the wellhead assembly forms a groove and the actuating cam surface is adapted to cause the lock ring to move between an engaged condition with the groove when the isolation sleeve is coupled to the wellhead assembly and a disengaged condition with the groove when the isolation sleeve is decoupled from the wellhead assembly.

* * * * *